US009138654B2

(12) United States Patent
Li

(10) Patent No.: US 9,138,654 B2
(45) Date of Patent: Sep. 22, 2015

(54) NON-ADHESIVE WING CONNECTOR FOR AIRCRAFT MODELS

(71) Applicant: AnYang LanYu Model Co., Ltd., Anyang Henan (CN)

(72) Inventor: Wenqi Li, Anyang Henan (CN)

(73) Assignee: Anyang Lanyu Model Co., Ltd., Anyang Henan (CN)

( * ) Notice: Subject to any disclaimer, the term of this patent is extended or adjusted under 35 U.S.C. 154(b) by 0 days.

(21) Appl. No.: 14/282,528

(22) Filed: May 20, 2014

(65) Prior Publication Data

US 2014/0349542 A1 Nov. 27, 2014

(30) Foreign Application Priority Data

May 21, 2013 (CN) ..... 2013 1 0188362
May 21, 2013 (CN) ..... 2013 2 0277099

(51) Int. Cl.
*A63H 27/00* (2006.01)

(52) U.S. Cl.
CPC ..... *A63H 27/02* (2013.01)

(58) Field of Classification Search
USPC ..... 446/34, 61, 62, 66, 67, 68, 88, 93
See application file for complete search history.

(56) References Cited

U.S. PATENT DOCUMENTS

| | | | | | |
|---|---|---|---|---|---|
| 1,842,434 | A | * | 1/1932 | Tyrrell | 446/62 |
| 1,920,746 | A | * | 8/1933 | Guillow | 446/62 |
| 2,724,211 | A | | 11/1955 | Bloom | |
| 2,739,414 | A | * | 3/1956 | Cleveland | 446/66 |
| 3,380,189 | A | * | 4/1968 | O'Millian | 446/62 |
| 3,778,926 | A | * | 12/1973 | Gladych | 446/66 |
| 5,423,706 | A | * | 6/1995 | Chase | 446/62 |
| 5,853,312 | A | | 12/1998 | Li | |

FOREIGN PATENT DOCUMENTS

| | | | |
|---|---|---|---|
| CN | 202122834 | U | 1/2012 |
| DE | 25 20 166 | B1 | 6/1976 |
| DE | 26 20 297 | A1 | 11/1977 |
| DE | 26 56 442 | B1 | 5/1978 |

OTHER PUBLICATIONS

Extended European Search Report for European Application No. 13184627.1-1658, dated Sep. 24, 2014, 5 pages.
European Search Report for European Patent Application No. 13180179.7-1658, dated Jun. 30, 2014, 6 pages.

* cited by examiner

*Primary Examiner* — Nini Legesse
(74) *Attorney, Agent, or Firm* — Westman, Champlin & Koehler, P.A.

(57) ABSTRACT

A non-adhesive wing connector comprising at least one left wing installation surface and at least one right wing installation surface passing through a central line of the non-adhesive wing connector by section, wherein a dihedral angle made on the left wing installation surface and the right wing installation surface corresponds with finger holes made on the edge of both wings in order to plug them together.

7 Claims, 3 Drawing Sheets

NON-ADHESIVE WING CONNECTOR FOR AIRCRAFT MODELS

CROSS-REFERENCE TO RELATED APPLICATION

This Application is a non-provisional Application of Chinese Application Nos. CN 201320277099.0, filed May 21, 2013, and CN 201310188362.3, filed May 21, 2013 in Chinese, the contents of which are hereby incorporated by reference in their entirety.

The present invention can be used to connect the wings and the fuselage of aircraft models. The function of this wing connector is to precisely position the wings and to connect the wings together. It also provides a non-adhesive wing connector that is an accessory for aircraft model-making.

BACKGROUND

During the activities of aircraft model-making, many amateurs, especially younger amateurs, have problems gluing the wings to the fuselage of a wooden aircraft model. Some young children have been harmed by using glue during the process of making aircraft models, for example fingers sticking together such that they cannot be separated and require hospital treatment. It is considered a serious impediment for the popularity of aircraft model-making by young children.

An object of the present invention is to solve the inconvenience and potential dangers encountered when using glue during aircraft model making. The wing connector can easily and safely be used to connect the wings and the fuselage for wood models. It positions precisely the wings to be connected together with the fuselage. It also makes a wider range of aircraft model-making activities more suitable for young children.

A possible embodiment of the non-adhesive wing connector is shown in more detail in the enclosed figures.

DESCRIPTION OF EMBODIMENTS

Figure 1:
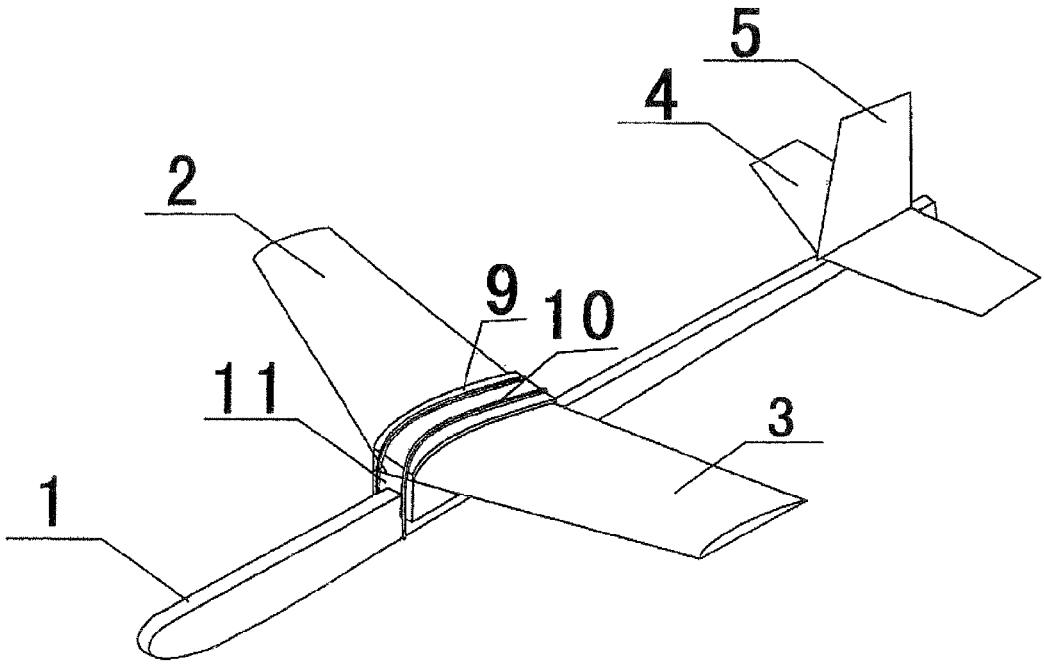
FIG. 1 shows a general assembly diagram of an aircraft model.
Figure 2:
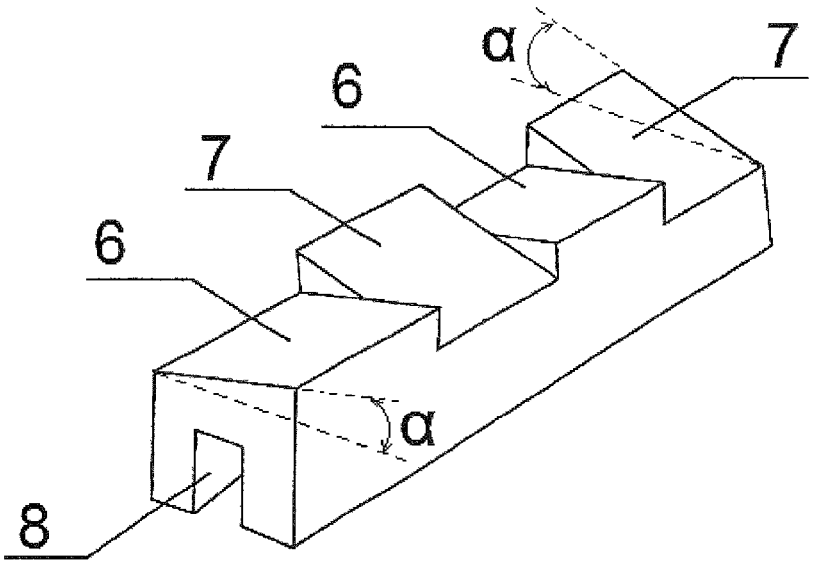
FIG. 2 shows a non-adhesive wing connector drawing of an aircraft model.
Figure 3:
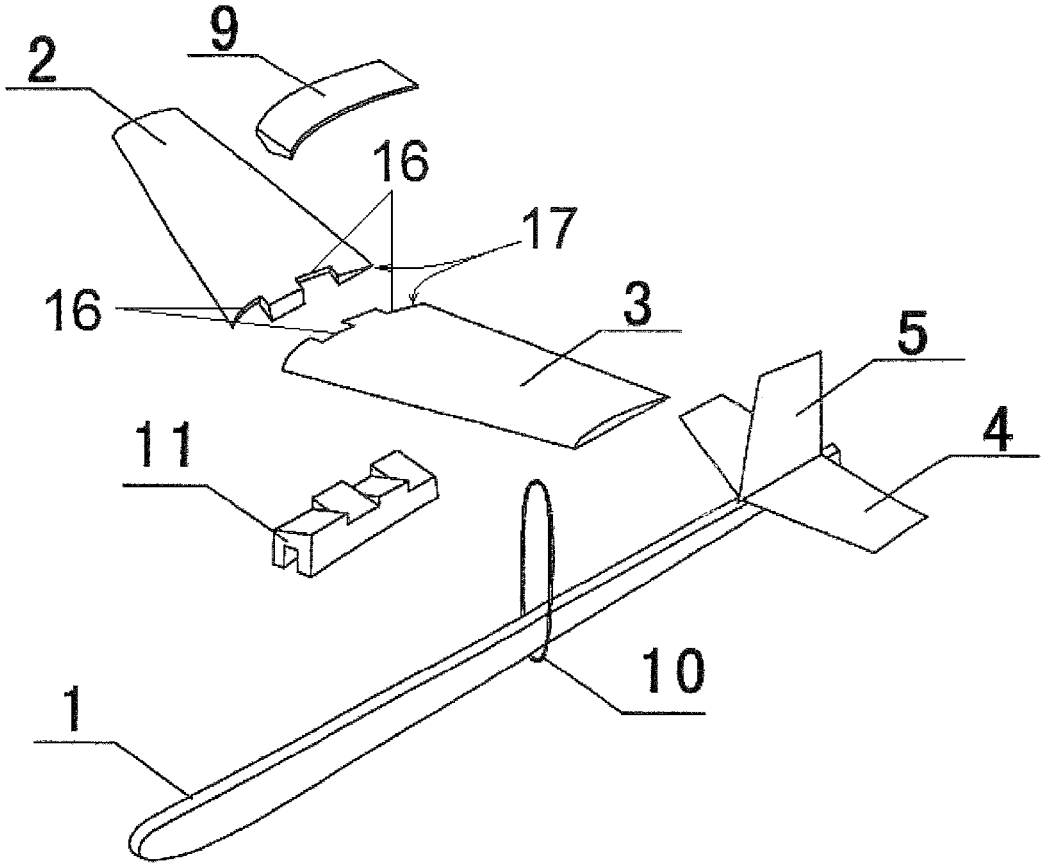
FIG. 3 shows a non-adhesive wing connector assemble schematic drawing of an aircraft model.
Figure 4:
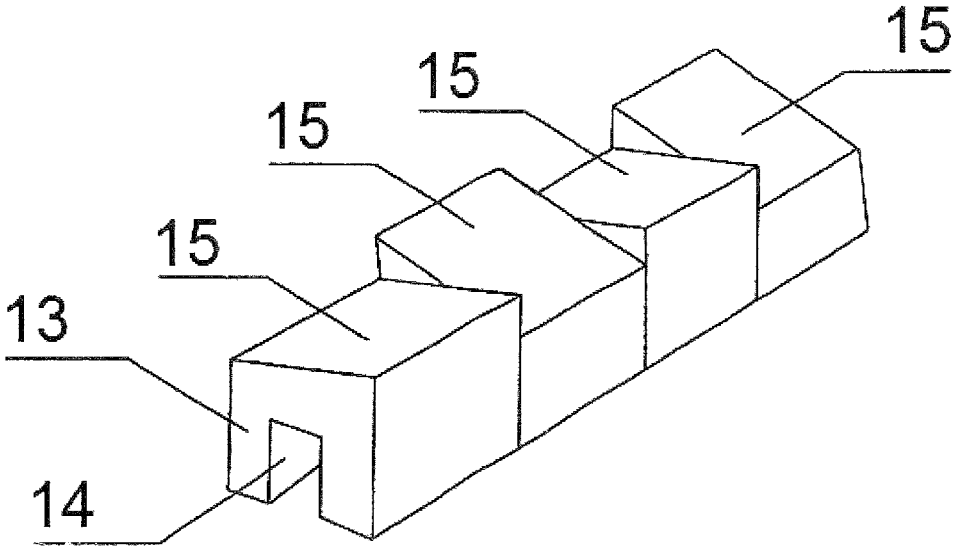
FIG. 4 shows a section combined non-adhesive wing connector drawing.
Figure 5:
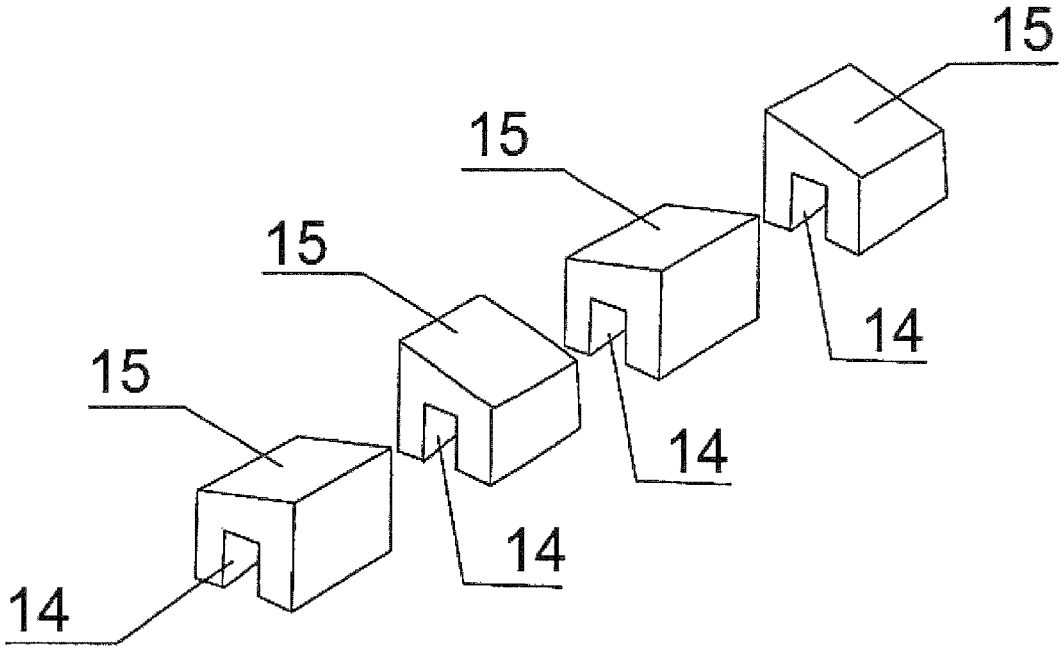
FIG. 5 shows a section combined non-adhesive wing connector schematic drawing.

One surface 14 of the wing connector 11 matches the fuselage 1 in order to connect it. The other side of the surface 15 (as FIGS. 4 and 5 show), is made with different-angled parts and a central line passed through all parts. The surface of the parts match up with finger holes 16 on the edge 17 of the wings 2, 3 in order to plug them together. At the same time, a tablet 9 and a rubber band 10 are used to fix the wing connector 11 with the wings 2, 3 together on the fuselage 1 of the aircraft model. The corresponding dihedral angle $\alpha$ on one side of the wing connector 11 is already made for fitting both sides of the wings 2, 3, hence one does not need to do a measurement of positioning during the installation of the wings 2, 3. The installation can be accomplished fast and precisely. At the same time, the left wing 3 and right wing 2 will go through the central line of the wing connector 11 hence increasing the arm length of the wings 2, 3 and consequently maximizing the stability of both wings 2, 3 on the fuselage 1.

The reference numbers used in FIGS. 1 to 5 are as follows:

1. fuselage
2. right wing
3. left wing
4. horizontal tail
5. vertical tail
6. left wing installation surface
7. right wing installation surface
8. fuselage installation surface
9. tablet compressing
10. rubber band
11. non-adhesive wing connector
13. section combined non-adhesive wing connector
14. surface of section combined non-adhesive wing connector
15. surface of section combined non-adhesive wing connector
16. finger holes
17. finger hole edge Assembly By use of the FIGS. 1 to 5, first of all, the fuselage installation surface 8 of the non-adhesive wing connector 11 is put on the fuselage 11. Then the left wing 3 and the right wing 2 plug are put into the non-adhesive wing connector 11 of the left wing installation surface 6 and right wing installation surface 7. The tablet 9 is used to compress on the finger hole edge 17 of the left wing 3 and the right wing 2. Then a rubber band 10 is used to fix the non-adhesive wing connector 11 with the left wing 3 and the right wing 2 together with the tablet 9 on the fuselage 1. To conclude, the installation between the fuselage 1 and the wings 2, 3 is more convenient and the wings 2, 3 are more stable by using the non-adhesive wing connector 11 according to the present invention as shown in the embodiment of FIGS. 1 to 5.

The invention claimed is:

1. A non-adhesive wing connector configured to connect a left wing and a right wing to a fuselage of a model aircraft, each of said left and right wings having holes or recesses at a respective connection edge region thereof, said non-adhesive wing connector comprising:

at least one left wing installation surface and at least one right wing installation surface passing through a central line of the non-adhesive wing connector by section, wherein a dihedral angle is formed by each of the left wing installation surface and the right wing installation surface and wherein the left and right wing installation surfaces are configured to match with said holes or recesses at the connecting edge regions of the respective wings in order to plug them together.

2. The non-adhesive wing connector according to claim 1, wherein the non-adhesive wing connector is made from two or more sections combined together as section components of a combined non-adhesive wing connector, wherein each of the section components of the combined non-adhesive wing connector forms at least one corresponding dihedral angle for the left wing and the right wing at a surface of the section combined non-adhesive wing connector.

3. The non-adhesive wing connector according to claim 1, comprising a fuselage connecting portion at a lower surface or an underside thereof for connection with a fuselage of the model aircraft.

4. The non-adhesive wing connector according to claim 3, wherein the fuselage connecting portion comprises a downwardly open slot configured to receive and match with the fuselage.

5. The non-adhesive wing connector according to claim 1, comprising a cover member for covering and compressing the connecting edge region of each wing comprising the respective holes or recesses.

6. The non-adhesive wing connector according to claim 4, comprising a rubber band that is configured to fix the cover member over the connecting edge regions of the left wing and the right wing connected together on the fuselage.

7. A model aircraft comprising: a fuselage, a left wing, a right wing, and a non-adhesive wing connector according to claim 1 for connecting said left wing and said right wing to said fuselage.

* * * * *